US005670868A

United States Patent [19]

Moriguchi et al.

[11] Patent Number: 5,670,868

[45] Date of Patent: Sep. 23, 1997

[54] LOW-CONSTANT VOLTAGE SUPPLY CIRCUIT

[75] Inventors: Akisada Moriguchi, Ome; Osamu Yumoto, Urawa; Masaharu Hata, Yokohama; Hironori Saito, Ome; Teruhisa Azumaguchi, Yokohama, all of Japan

[73] Assignee: Hitachi, Ltd., Tokyo, Japan

[21] Appl. No.: 546,036

[22] Filed: Oct. 20, 1995

[30] Foreign Application Priority Data

Oct. 21, 1994 [JP] Japan ..... 6-256762

[51] Int. Cl.[6] ..... G05F 3/16; G05F 3/20

[52] U.S. Cl. ..... 323/313; 323/315

[58] Field of Search ..... 323/313, 314, 323/315, 316

[56] References Cited

U.S. PATENT DOCUMENTS

| | | | |
|---|---|---|---|
| 5,349,286 | 9/1994 | Marshal et al. | 323/315 |
| 5,381,083 | 1/1995 | Inamori et al. | 323/313 |
| 5,521,544 | 5/1996 | Hatanaka | 323/315 |
| 5,530,340 | 6/1996 | Hayakawa et al. | 323/314 |

OTHER PUBLICATIONS

Analog IC Design Technology for LSI, vol. 1 (1990), p. 275, by P.R. Grey and R.G. Mayer.

*Primary Examiner*—Peter S. Wong
*Assistant Examiner*—Bao Q. Vu
*Attorney, Agent, or Firm*—Antonelli, Terry, Stout & Kraus, LLP.

[57] ABSTRACT

A constant-voltage power source circuit includes a first current mirror circuit having a diode and a first transistor and a second current mirror circuit having at least second and third transistors, which sets a current flowing to the first current mirror circuit to be substantially equal to a current flowing to the second mirror circuit, and provides the current flowing to the second current mirror circuit to a fourth transistor that determines an output voltage. With this arrangement, a current flowing to the current mirror circuits structured by the diode and transistors is determined by a forward characteristic of the diode, and this current becomes a constant current which is hardly affected by a variation of a power source voltage. When this current flows to the two current mirror circuits including transistors and then flows to the transistor which determines an output voltage, it is possible to hold a voltage between the base and the emitter of the transistor which determines an output voltage, at substantially a constant value without being affected by a variation of the power source voltage.

16 Claims, 4 Drawing Sheets

LOW-CONSTANT VOLTAGE SUPPLY CIRCUIT

BACKGROUND OF THE INVENTION

The present invention relates to a constant-voltage power source circuit suitable for use in supplying a power to an integrated circuit that requires a low-power voltage operation, and relates more particularly to a constant-voltage power source circuit which can stabilize an output voltage by minimizing a power source voltage dependency and which can operate at a low power voltage.

As a technique relating to a constant-voltage power source circuit of this type, a technique described in the Analog IC Design Technology for LSI, vol. 1 (1990), p. 275, by P. R. Grey and R. G. Mayer, for example, is known.

SUMMARY OF THE INVENTION

It is an object of the present invention to provide a constant-voltage power source circuit which can minimize the dependency of a current, that flows to a transistor for determining an output voltage, on a power source voltage to thereby minimize the output voltage dependency on the power source voltage, and which can thus obtain a stable output voltage.

It is a first aspect of embodiment of the present invention that a constant-voltage power source circuit consists of a first current mirror circuit including a diode and a first transistor and a second current mirror circuit including at least second and third transistors, that a current flowed to the first current mirror circuit is set substantially equal to a current flowed to the second current mirror circuit, and the current flowed to the second current mirror circuit is flowed to a fourth transistor that determines an output voltage.

Further, according to the above first aspect, the first current mirror circuit includes a diode, cathode of which is connected to one of power source voltage terminal and a first NPN type transistor, a base of which is connected to an anode of the diode, and the second current mirror circuit includes second and third PNP type transistors, bases of which are connected in common; emitters of the second and third transistors respectively of the second current mirror circuit are connected to the other power source voltage terminal, a collector of the second transistor is connected to at least a collector of the first transistor of the first current mirror circuit, and an emitter of the first transistor is connected to the above one power source voltage terminal; the collector of the first transistor is connected to a base of a fifth PNP type transistor, an emitter of the fifth transistor is connected to the bases of the second and third transistors respectively, and a collector of the fifth transistor is connected to the one power source voltage terminal, a collector of the third transistor of the second current mirror circuit is connected to at least a collector of a fourth NPN type transistor, and an emitter of the fourth transistor is connected to the one power source voltage terminal; and a current from flowing in the collector of the second transistor of the second current mirror circuit to the collector of the first transistor of the first current mirror circuit is set substantially equal to a current from flowing in the collector of the third transistor of the second current mirror circuit to the collector of the fourth transistor for determining an output voltage.

It is a second aspect of the embodiment of the present invention that a constant-voltage power source circuit includes a first current mirror circuit including a diode, cathode of which is connected to one of power source voltage terminal and a first NPN type transistor, a base of which is connected to an anode of the diode and a second current mirror circuit including second and third PNP type transistors, bases of which are connected in common; emitters of the second and third transistors respectively of the second current mirror circuit are connected to the other power source voltage terminal, a collector of the second transistor is connected to at least a collector of the first transistor of the first current mirror circuit, and an emitter of the first transistor is connected to the above one power source voltage terminal; the collector of the first transistor is connected to a base of a fifth PNP type transistor, an emitter of the fifth transistor is connected to the bases of the second and third transistors respectively, and a collector of the fifth transistor is connected to the one power source voltage terminal; a collector of the third transistor of the second current mirror circuit is connected to at least a collector of a fourth NPN type transistor, and an emitter of the fourth transistor is connected to the one power source voltage terminal; a current from flowing in the collector of the second transistor of the second current mirror circuit to the collector of the first transistor of the first current mirror circuit is set substantially equal to a current from flowing in the collector of the third transistor of the second current mirror circuit to the collector of the fourth transistor for determining an output voltage; an anode of the diode of the first current mirror circuit and a base of the first transistor are connected to an emitter of a sixth NPN type transistor, and a collector of the sixth transistor is connected to the other power source voltage terminal; a base of the fourth transistor for determining an output voltage is connected to an emitter of a seventh NPN type transistor and is also connected to a collector of an eighth NPN type transistor, an emitter of the eighth transistor is connected to the one power source voltage terminal, and a collector of the seventh transistor is connected to the other power source voltage terminal; at least the collector of the fourth transistor is connected to bases of the sixth and seventh transistors and is also connected to a base of a ninth NPN type transistor for supplying an output voltage, and a collector of the ninth transistor is connected to the other power source voltage terminal and an emitter of the ninth transistor is connected to the one power source voltage terminal through predetermined resistor element, to thereby form an output circuit; such a plurality of output circuits are connected in parallel to both power source voltage terminals, the first transistor is driven by a current flowed from the emitter of the sixth transistor, the fourth transistor is driven by a current flowed from the emitter of the seventh transistor, and the sixth, seventh and ninth transistors are driven by at least a collector voltage of the fourth transistor so that a plurality of same output voltages are supplied.

It is a third aspect of the embodiment of the present invention that a resistor element different value from the resistor element in the output circuit of the second aspect previously described is connected between the emitter of ninth transistor and a terminal for supplying an output voltage. Such a plurality of output circuits having series connected resistor elements of different values are connected in parallel to both of the power source voltage terminals; the first transistor is driven by a current flowed from the emitter of the sixth transistor, the fourth transistor is driven by a current flowed from the emitter of the seventh transistor, and the sixth, seventh and ninth transistors are driven by at least a collector voltage of the fourth transistor so that a plurality of different output voltages are supplied.

The above-described constant-voltage power source circuits are formed as integrated circuits.

By using the constant-voltage power source circuits of the above-described structure, a current flowed to current mirror circuits formed by diodes and transistors is determined according to a forward characteristic of the diodes. This current becomes a constant current which is hardly affected by a variation of the power source voltage. When this current is flowed to the two current mirror circuits including transistors and is then flowed to the transistor which determines an output voltage, it is possible to hold a voltage between the base and the emitter of the transistor which determines an output voltage, at substantially a constant value without being affected by a variation of the power source voltage.

DESCRIPTION OF THE PREFERRED EMBODIMENTS

Embodiments of the constant-voltage power source circuit according to the present invention will be explained below with reference to the drawings.

Figure 1:
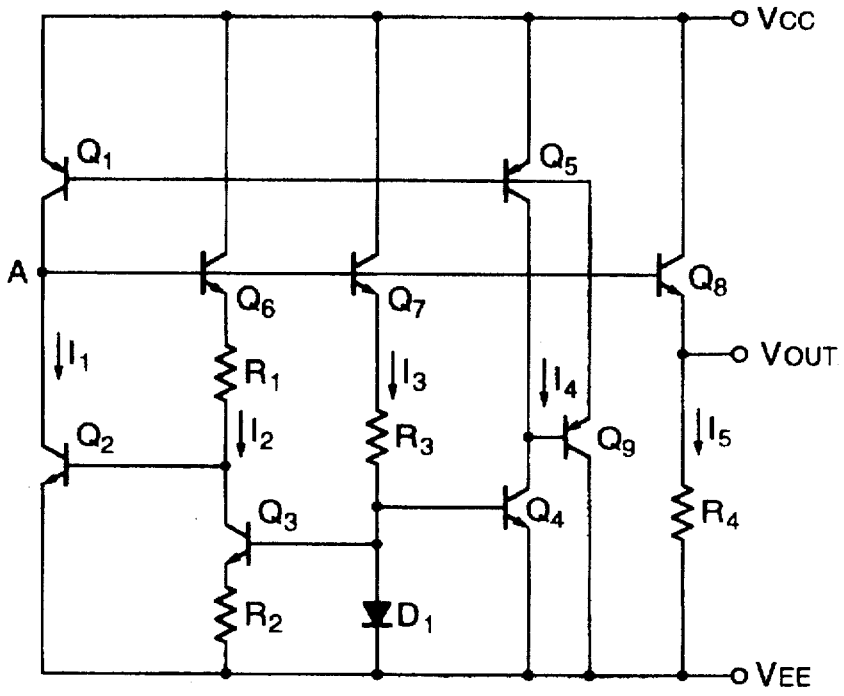
FIG. 1 is a circuit diagram showing one embodiment of the constant-voltage power source circuit according to the present invention.

FIG. 1 is a circuit diagram showing a structure of the constant-voltage power source circuit according to one embodiment of the present invention. In FIG. 1, $Q_1$ to $Q_9$ designate transistors, $R_1$ to $R_4$ designate resistors and $D_1$ designates a diode.

Referring to a first embodiment of the present invention shown in FIG. 1, the diode $D_1$ and the NPN transistor $Q_4$ constitute a first current mirror circuit, and the PNP transistors $Q_1$ and $Q_5$ constitute a second current mirror circuit. The circuit shown in FIG. 1 are structured such that the first current mirror formed by the diode $D_1$ and the NPN transistor $Q_4$ generates a current, which is negligibly affected by a variation of a power source voltage $V_{CC}$, as a collector current $I_4$ of the transistor $Q_4$, and the second current mirror circuit formed by the PNP transistors $Q_1$ and $Q_5$ flows a current of substantially the same value as the value of the collector current $I_4$ to the transistor $Q_2$ which determines an output voltage of the constant-voltage power source.

The collector current $I_1$ flowed to the transistor $Q_2$ is a current that is little affected by a variation of the power source voltage $V_{CC}$, and therefore, it is possible to set a voltage $V_{BE}$ between the base and the emitter of the transistor $Q_2$ to substantially a constant value regardless of the variation of the power source voltage $V_{CC}$. As a result, the circuit shown in FIG. 1 can minimize an influence of the power source voltage $V_{CC}$ that is affected to an output voltage $V_{OUT}$, so that it is possible to produce a stable output voltage.

The above system will be explained in further detail. In the first embodiment of the present invention shown in FIG. 1, when base-emitter voltages of the transistors $Q_1$ to $Q_9$ are expressed as $V_{BE}$ ($Q_n$), the output voltages $V_{OUT}$ can be expressed as follows.

$$V_{OUT}=V_{BE}(Q_2)+V_{BE}(Q_6)+V_{BE}(Q_8)+R_1*I_2$$

Further, when the potential of a point A in FIG. 1 is $V_A$, $V_A$ can be expressed as follows.

$$V_A=V_{BE}(Q_2)+V_{BE}(Q_6)+R_1*I_2$$

The base-emitter voltages $V_{BE}$ of the transistors $Q_1$ to $Q_9$ can be generally expressed as follows.

$$V_{BE}=(kT/q)\ln(I_C/S*I_O)$$

where, k: Boltzmann factor,

T: absolute temperature, q: electron charge, $I_C$: collector current,

S: emitter area, and $I_O$: backward saturation current per unit area.

According to the circuit shown in FIG. 1, when the magnitude of the influence of the power source voltage $V_{CC}$ affected to the collector current $I_1$ of the transistor $Q_2$ is small, the magnitude of the influence of the power source voltage $V_{CC}$ affected to the potential $V_A$ at the point A can be made small. The collector current $I_1$ can have substantially the same current value as the value of the collector current $I_4$ of the transistor $Q_4$ when the current mirror circuits according to the PNP transistors $Q_1$ and $Q_5$ are used. Accordingly, when the collector current $I_4$ of the transistor $Q_4$ has minimum influence from the power source voltage $V_{CC}$, the collector current $I_1$ of the transistor $Q_2$ is minimum affected by the power source voltage $V_{CC}$.

The reason why the collector current $I_4$ of the transistor $Q_4$ is minimum affected by the power source voltage $V_{CC}$ will be explained below.

In the first current mirror circuit structured by the diode $D_1$ and the NPN transistor $Q_4$, $I_3$ is equal to $I_4$, and the base-emitter voltage $V_{BE}(Q_4)$ of the transistor $Q_4$ and the forward voltage $V_{BE}(D_1)$ of the diode $D_1$ are expressed respectively as follows.

$$V_{BE}(Q_4)=(kT/q)\ln(I_4/S_4*I_O)$$

$$V_{BE}(D_1)=V_{BE}(Q_4)$$

From the above expressions, the following expression can be drawn.

$$V_{BE}(D_1)=(kT/q)\ln(I_4/S_4*I_O) \quad (1)$$

where, $S_4$: emitter area of the transistor $Q_4$

As is clear from the expression (1), the collector current $I_4$ of the transistor $Q_4$ can be expressed by the expression (1) of voltage drop of the diode $D_1$. The influence of the forward power source voltage $V_{BE}(D_1)$ of the diode $D_1$ is known to be smaller than the influence of a voltage drop by a resistance. Accordingly, it is possible to minimize the influence of the power source voltage affected to the collector current $I_4$ of the transistor $Q_4$. Therefore, the current $I_1$ having the same value as the value of the collector current $I_4$ can be minimum affected by the power source voltage, so that the influence of the power source voltage to the potential $V_A$ at the point A in FIG. 1 can be minimized.

Further, since a base-emitter voltage $V_{BE}(Q_8)$ of the transistor $Q_8$ is constant, the output voltage $V_{OUT}$ is minimum affected by the power source voltage $V_{CC}$, and a stable output voltage can be produced. Further, since the circuits according to the present invention can be structured by reducing the number of vertical stages of connecting transistors, it is possible to operate the circuits by setting the power source voltage $V_{CC}$ to a low voltage of about $V_{OUT}+2V_{BE}$.

The constant-voltage power source circuits having the above-described structures can supply a relatively lower voltage than that of known 5 volts. The constant-voltage power source circuit is formed in an integrated circuit. Further, a plurality of other diodes can also be formed in parallel with the diode $D_1$. In this case, it is possible to reduce variations in the characteristics of the diodes. On the other hand, there arises a disadvantage that a current increases.

Figure 2:
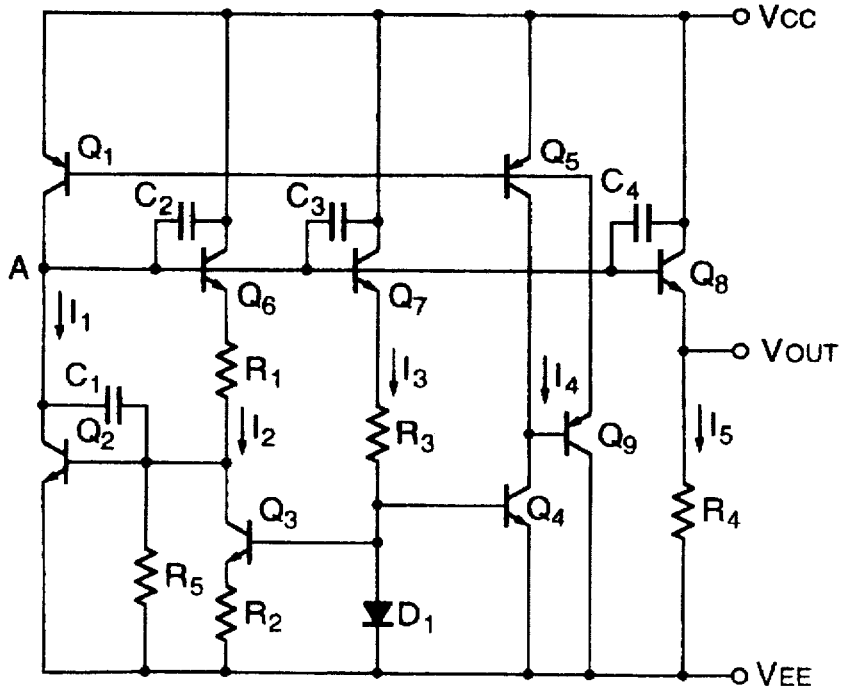
FIG. 2 is a circuit diagram showing another embodiment of the constant-voltage power source circuit according to the present invention.

FIG. 2 shows another embodiment of the constant-voltage power source circuit. Referring to FIG. 2, capacitors $C_1$, $C_2$, $C_3$ and $C_4$ are formed between respective bases and collectors of transistors $Q_2$, $Q_6$, $Q_7$ and $Q_8$. These capacitors $C_1$, $C_2$, $C_3$ and $C_4$ are formed in the manufacturing process of the integrated circuit, and variations of the power source voltage $V_{CC}$ supplied to the respective collectors can be eliminated. Further, by forming a resistor $R_5$ between the base and the collector of the transistor $Q_2$, the operation of the transistors $Q_2$ and $Q_3$ can be stabilized.

Figure 3:
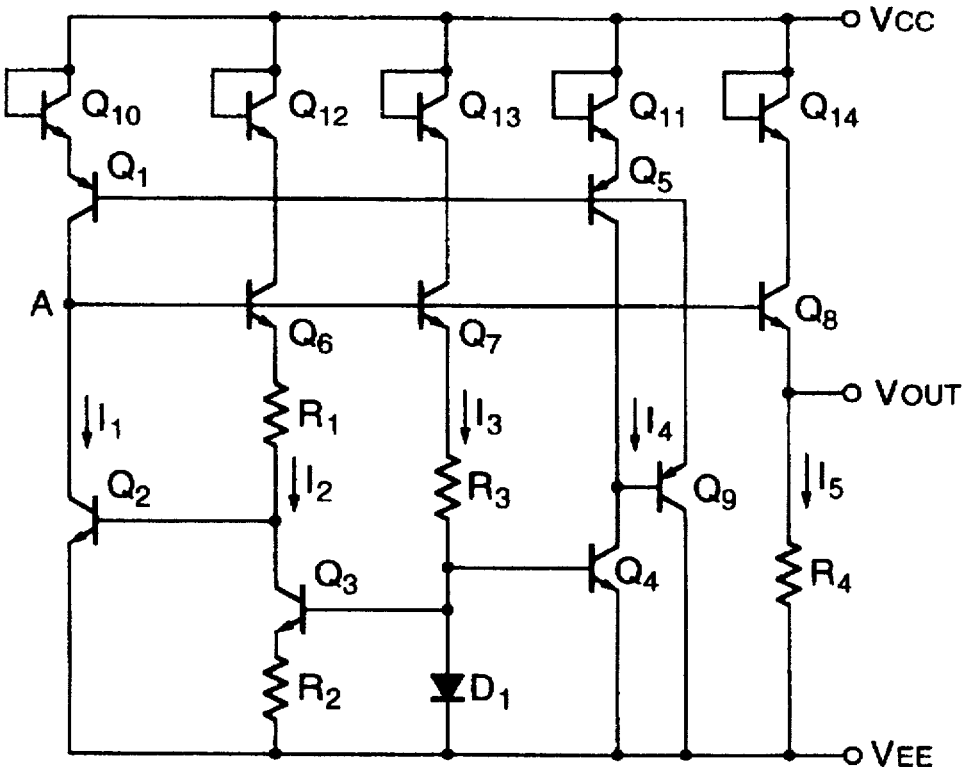
FIG. 3 is a circuit diagram showing still another embodiment of the constant-voltage power source circuit according to the present invention.

FIG. 3 shows still another embodiment of the constant-voltage power source circuit. Referring to FIG. 3, transistors $Q_{10}$, $Q_{11}$, $Q_{12}$, $Q_{13}$ and $Q_{14}$ having their bases and collectors connected together are connected between respective collectors of transistors $Q_1$, $Q_5$, $Q_6$, $Q_7$ and $Q_8$ and the terminal of the power source voltage $V_{CC}$. These transistors $Q_{10}$, $Q_{11}$, $Q_{12}$, $Q_{13}$ and $Q_{14}$ are equivalent to diodes as know, which can set the power source voltage $V_{CC}$ to a voltage higher than the voltage drop across the diodes. In the constant-voltage power source circuit formed as shown in FIG. 3, it is also possible to form the capacitors $C_1$, $C_2$, $C_3$ and $C_4$ as explained based on FIG. 2, and it is also possible to form the resistor $R_5$ in a similar manner.

Figure 4:
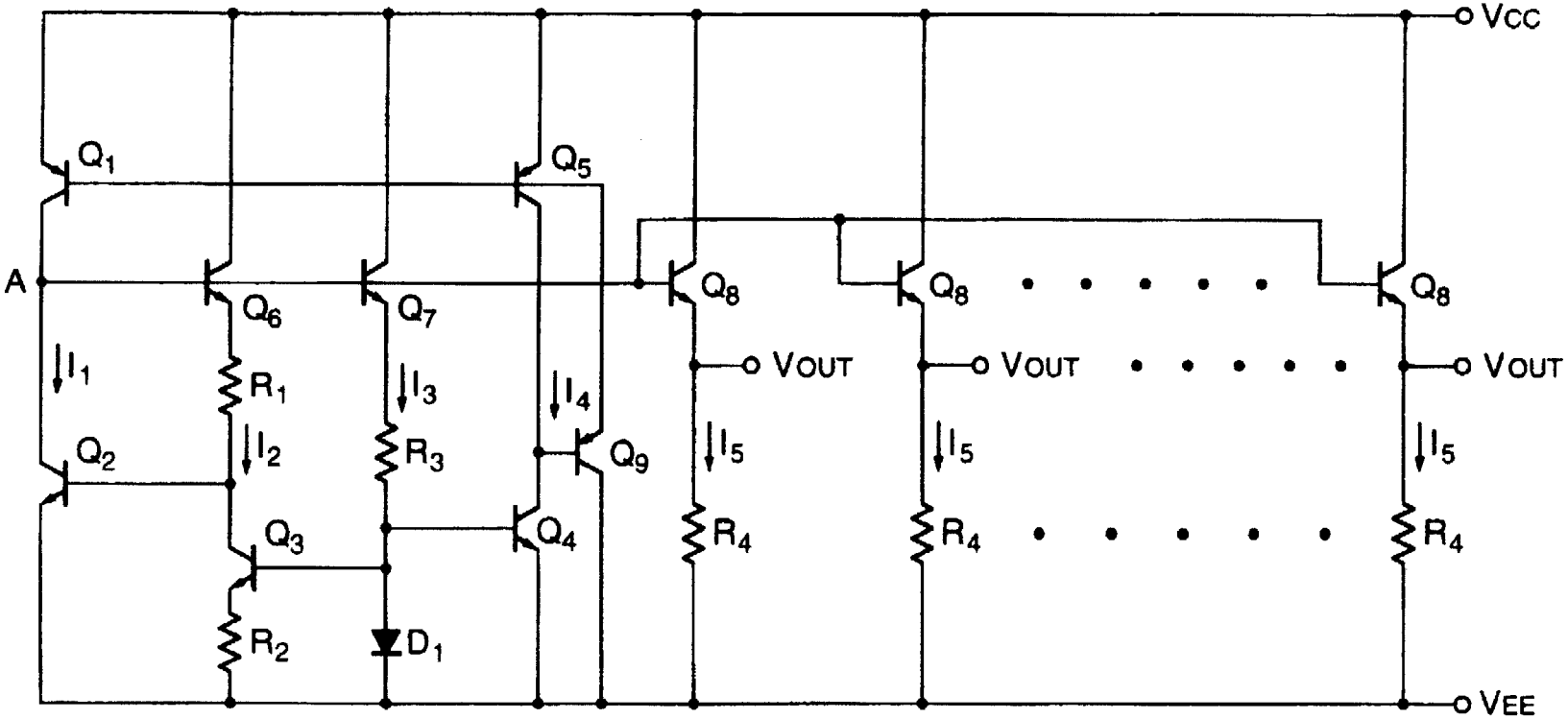
FIG. 4 is a circuit diagram showing still another embodiment of the constant-voltage power source circuit according to the present invention.

FIG. 4 shows still another embodiment of the constant-voltage power source circuit, wherein in the constant-voltage power source circuit shown in FIG. 1, a plurality of circuits including the transistor $Q_8$, the resistor $R_4$ and the terminal $V_{OUT}$ for outputting an output voltage are connected in parallel to respective terminals of the power source voltage $V_{CC}$ and a power source voltage $V_{EE}$. Bases of the respective transistors $Q_8$ are connected in common. With this arrangement, a plurality of same voltages $V_{OUT}$, $V_{OUT}$, . . . $V_{OUT}$ can be supplied. In the constant-voltage power source circuit of this example, it is possible to form the capacitors $C_1$, $C_2$, $C_3$ and $C_4$ and the resistor $R_5$ as explained in FIG. 2, and it is also possible to form the transistors $Q_{10}$, $Q_{11}$, $Q_{12}$, $Q_{13}$ and $Q_{14}$ as explained in FIG. 3.

Figure 5:
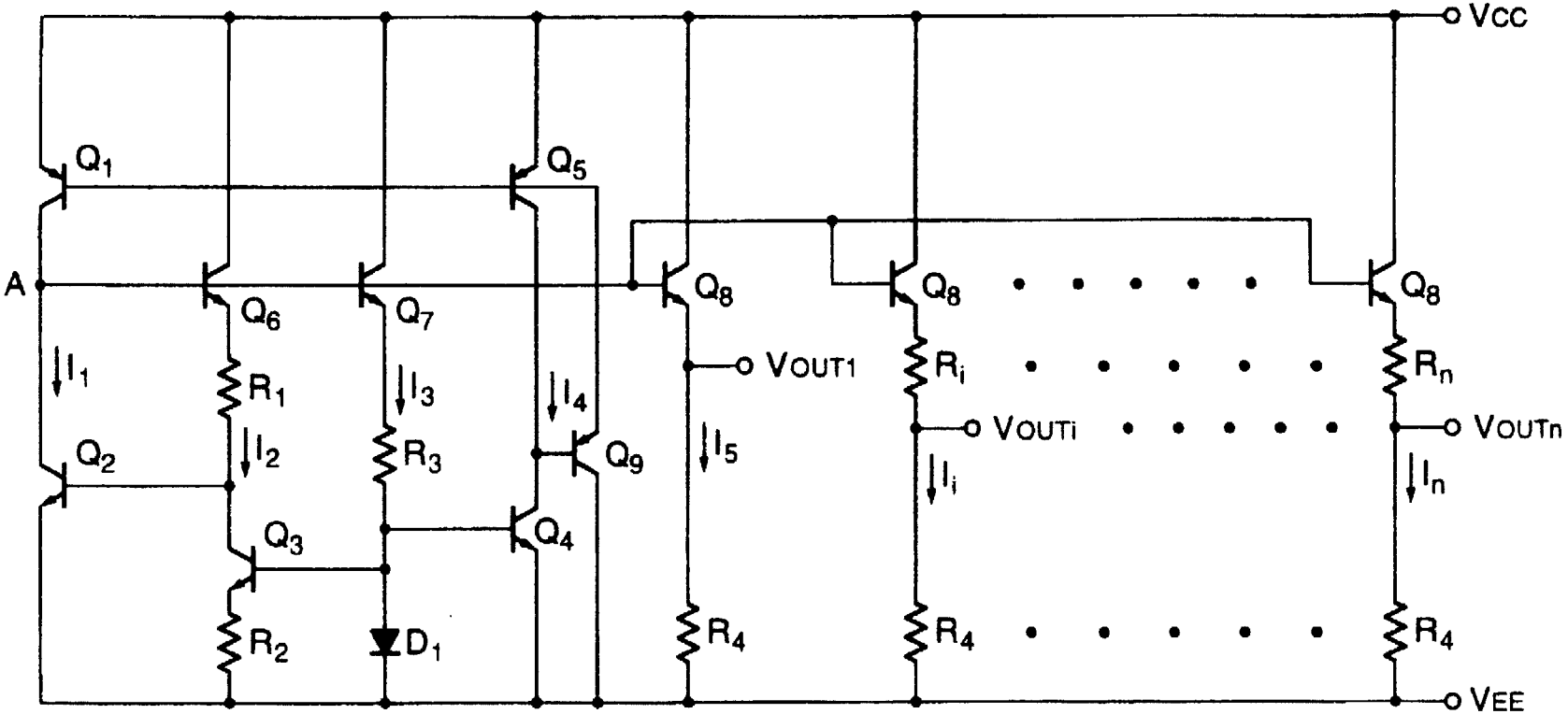
FIG. 5 is a circuit diagram showing still another embodiment of the constant-voltage power source circuit according to the present invention.

FIG. 5 shows still another embodiment of the constant-voltage power source circuit, wherein in the constant-voltage power source circuit shown in FIG. 1, of the circuit including the transistor $Q_8$, the resistor $R_4$ and the terminal for outputting an output voltage $V_{OUT1}$, a plurality of circuits having connected respective resistors from $R_i$ to $R_n$ of different resistance values between the transistor $Q_8$ and the terminal for outputting the output voltage $V_{OUT}$, are connected in parallel to respective terminals to which the power source voltages $V_{CC}$ and $V_{EE}$ are applied. With this arrangement, it is possible to supply a plurality of different voltages $V_{OUT1}$, $V_{OUTi}$, . . . $V_{OUTn}$ which are determined by different resistance values. In the constant-voltage power source circuit of this example, similar to the diagram as shown in FIG. 4, it is also possible to form the capacitors $C_1$, $C_2$, $C_3$ and $C_4$ and the resistor $R_5$ shown in FIG. 2, and it is also possible to form the transistors $Q_{10}$, $Q_{11}$, $Q_{12}$, $Q_{13}$ and $Q_{14}$ shown in FIG. 3.

The constant-voltage power source circuits shown in FIGS. 1 to 5 are formed as integrated circuits.

What is claimed is:

1. A constant-voltage power source circuit comprising:

a first current mirror circuit including at least a diode and a first transistor; and a second current mirror circuit including at least second and third transistors; wherein a current which flows to said first current mirror circuit is set substantially equal to a current flowed to said second current mirror circuit, and a current flowed to said second current mirror circuit is flowed to a fourth transistor that determines an output voltage, wherein said first current mirror circuit includes a diode, a cathode of which is connected to one of power source voltage terminal and a first NPN type transistor, a base of which is connected to an anode of said diode, and said second current mirror circuit includes second and third PNP type transistors, bases of which are connected in common, emitters of said second and third transistors respectively of said second current mirror circuit are connected to the other power source voltage terminal, a collector of said second transistor is connected to at least a collector of said first transistor of said first current mirror circuit, and an emitter of said first transistor is connected to said first power source voltage terminal;

said collector of said first transistor is connected to a base of a fifth PNP type transistor, an emitter of said fifth transistor is connected to bases of said second and third transistors respectively, and a collector of said fifth transistor is connected to one power source voltage terminal;

a collector of said third transistor of said second current mirror circuit is connected to at least a collector of a fourth NPN type transistor, and an emitter of said fourth transistor is connected to said one power source voltage terminal; and a current from flowing in said collector of said second transistor of said second current mirror circuit to said collector of said first transistor of said first current mirror circuit, is set substantially equal to a current from flowing in said collector of said third transistor of said second current mirror circuit to said collector of said fourth transistor for determining an output voltage.

2. A constant-voltage power source circuit according to claim 1, wherein an anode of said diode of said first current mirror circuit and a base of said first transistor are connected to an emitter of a sixth NPN type transistor, and a collector of said sixth transistor is connected to said other power source voltage terminal;

a base of said fourth transistor for determining an output voltage is connected to an emitter of a seventh NPN type transistor and is also connected to a collector of an eighth NPN type transistor, an emitter of said eighth transistor is connected to said one power source voltage terminal, and a collector of said seventh transistor is connected to said other power source voltage terminal;

at least said collector of said fourth transistor is connected to bases of said sixth and seventh transistors and is also connected to a base of a ninth NPN type transistor for supplying an output voltage, and an emitter of said ninth transistor is connected to said one power source voltage terminal; and said first transistor is driven by a current flowed from said emitter of said sixth transistor, said fourth transistor is driven by a current flowed from said emitter of said seventh transistor, and said sixth, seventh and ninth transistors are driven by at least a collector voltage of said fourth transistor.

3. A constant-voltage power source circuit according to claim 2, wherein there is a capacitor between said base and said collector of at least said fourth, sixth, seventh and ninth transistors respectively.

4. A constant-voltage power source circuit according to claim 3, wherein there is a resistor element of a predetermined value between said base of said fourth transistor and said one power source voltage terminal.

5. A constant-voltage power source circuit according to claim 4, wherein there are diodes of predetermined rated values between said other power source voltage terminal and said collectors of said second, third, sixth, seventh and ninth transistors respectively.

6. A constant-voltage power source circuit according to claim 2, wherein a plurality of said diodes of the same rated values are connected in parallel.

7. A constant-voltage power source circuit, comprising:

a first current mirror circuit including a diode, a cathode of which is connected to one of power source voltage terminals and a first NPN type transistor, a base of which is connected to an anode of said diode; and a second current mirror circuit including second and third PNP type transistors, bases of which are connected in common;

wherein emitters of said second and third transistors respectively of said second current mirror circuit are connected to said other power source voltage terminal, a collector of said second transistor is connected to at least a collector of said first transistor of said first current mirror circuit, and an emitter of said first transistor is connected to said one power source voltage terminal;

said collector of said first transistor is connected to a base of a fifth PNP type transistor, an emitter of said fifth transistor is connected to said bases of said second and third transistors respectively, and a collector of said fifth transistor is connected to said one power source voltage terminal;

a collector of said third transistor of said second current mirror circuit is connected to at least a collector of a fourth NPN type transistor, and an emitter of said fourth transistor is connected to said one power source voltage terminal;

a current from flowing in said collector of said second transistor of said second current mirror circuit to said collector of said first transistor of said first current mirror circuit is set substantially equal to a current from flowing in said collector of said third transistor of said second current mirror circuit to said collector of said fourth transistor for determining an output voltage;

an anode of said diode of said first current mirror circuit and a base of said first transistor are connected to an emitter of a sixth NPN type transistor, and a collector of said sixth transistor is connected to said other power source voltage terminal;

a base of said fourth transistor for determining an output voltage is connected to an emitter of a seventh NPN type transistor and is also connected to a collector of an eighth NPN type transistor, an emitter of said eighth transistor is connected to said one power source voltage terminal, and a collector of said seventh transistor is connected to said other power source voltage terminal;

at least said collector of said fourth transistor is connected to respective bases of said sixth and seventh transistors and is also connected to a base of a ninth NPN type transistor for supplying an output voltage;

a collector of said ninth transistor is connected to said other power source voltage terminal, and an emitter of said ninth transistor is connected to said one power source voltage terminal through predetermined resistor element to thereby form an output circuit, and a plurality of said output circuits are connected in parallel to both of said power source voltage terminals; and said first transistor is driven by a current flowed from said emitter of said sixth transistor, said fourth transistor is driven by a current flowed from said emitter of said seventh transistor, and said sixth, seventh and ninth transistors are driven by at least a collector voltage of said fourth transistor such that a plurality of same output voltages are supplied.

8. A constant-voltage power source circuit according to claim 7, wherein there is a capacitor between said base and said collector of at least said fourth, sixth, seventh and ninth transistors respectively.

9. A constant-voltage power source circuit according to claim 8, wherein there is a resistor element of a predetermined value between said base of said fourth transistor and said one power source voltage terminal.

10. A constant-voltage power source circuit according to claim 9, wherein there are diodes of predetermined rated values between said other power source voltage terminal and said collectors of said second, third, sixth, seventh and ninth transistors respectively.

11. A constant-voltage power source circuit according to claim 4, wherein a plurality of said diodes of the same rated values are connected in parallel.

12. A constant-voltage power source circuit, comprising:

a first current mirror circuit including a diode, a cathode of which is connected to one of power source voltage terminals and a first NPN type transistor, a base of which is connected to an anode of said diode; and a second current mirror circuit including second and third PNP type transistors, bases of which are connected in common;

wherein emitters of said second and third transistors respectively of said second current mirror circuit are connected to said other power source voltage terminal, a collector of said second transistor is connected to at least a collector of said first transistor of said first current mirror circuit, and an emitter of said first transistor is connected to said one power source voltage terminal;

said collector of said first transistor is connected to a base of a fifth PNP type transistor, an emitter of said fifth transistor is connected to said bases of said second and third transistors respectively, and a collector of said fifth transistor is connected to said one power source voltage terminal;

a collector of said third transistor of said second current mirror circuit is connected to at least a collector of a fourth NPN type transistor, and an emitter of said fourth transistor is connected to said one power source voltage terminal;

a current from flowing in said collector of said second transistor of said second current mirror circuit to said collector of said first transistor of said first current mirror circuit, is set substantially equal to a current from flowing in said collector of said third transistor of said second current mirror circuit to said collector of said fourth transistor for determining an output voltage;

an anode of said diode of said first current mirror circuit and a base of said first transistor are connected to an emitter of a sixth NPN type transistor, and a collector of said sixth transistor is connected to said other power source voltage terminal;

a base of said fourth transistor for determining an output voltage is connected to an emitter of a seventh NPN type transistor and is also connected to a collector of an eighth NPN type transistor, an emitter of said eighth transistor is connected to said one power source voltage terminal, and a collector of said seventh transistor is connected to said other power source voltage terminal;

at least said collector of said fourth transistor is connected to respective bases of said sixth and seventh transistors and is also connected to a base of a ninth NPN type transistor for supplying an output voltage;

a collector of said ninth transistor is connected to said other power source voltage terminal, and an emitter of said ninth transistor is connected to said one power source voltage terminal through at least one resistor element to thereby form a plurality of output circuits having different resistance value for each of the output circuits, said plurality of said output circuits having at least series connected resistor element of different values are connected in parallel to both of said power source voltage terminals; and said first transistor is driven by a current flowed from said emitter of said sixth transistor, said fourth transistor is driven by a current flowed from said emitter of said seventh transistor, and said sixth, seventh and ninth transistors are driven by at least a collector voltage of said fourth transistor such that a plurality of different output voltages are supplied.

13. A constant-voltage power source circuit according to claim 13, wherein there is a capacitor between said base and said collector of at least said fourth, sixth, seventh and ninth transistors respectively.

14. A constant-voltage power source circuit according to claim 13, wherein there is a resistor element of a predetermined value between said base of said fourth transistor and said one power source voltage terminal.

15. A constant-voltage power source circuit according to claim 14, wherein there are diodes of predetermined rated values between said other power source voltage terminal and said collectors of said second, third, sixth, seventh and ninth transistors respectively.

16. A constant-voltage power source circuit according to claim 12, wherein a plurality of said diodes of the same rated values are connected in parallel.

* * * * *